United States Patent [19]

Crum et al.

[11] 4,099,776

[45] Jul. 11, 1978

[54] CONTROL ASSEMBLY FOR A RECLINING CHAIR

[75] Inventors: Donald Crum, Louisville; McKinley Goff, Middletown; Edward L. Hampton, Louisville, all of Ky.

[73] Assignee: Leggett & Platt, Incorporated, Carthage, Mo.

[21] Appl. No.: 667,099

[22] Filed: Mar. 15, 1976

[51] Int. Cl.[2] ..... A47C 1/02

[52] U.S. Cl. ..... 297/329; 297/68

[58] Field of Search ..... 297/68, 83, 85, 88, 297/89, 317, 318, 320–322, 329, 341–343; 248/393–395; 312/331; 214/1.1, 1.5; 254/10 R, 10.2

[56] References Cited

U.S. PATENT DOCUMENTS

| | | | |
|---|---|---|---|
| 426,602 | 4/1890 | Mühl | 297/68 |
| 427,331 | 5/1890 | Knaus | 312/331 |
| 609,389 | 8/1898 | Garland | 297/343 |
| 688,074 | 12/1901 | Dumke | 312/331 |
| 908,986 | 1/1909 | Flindall | 297/329 X |
| 928,566 | 7/1909 | Weis et al. | 312/331 |
| 951,705 | 3/1910 | Schultz | 312/331 |
| 1,171,974 | 2/1916 | Pelton | 312/331 |
| 1,201,638 | 10/1916 | Schaefer | 312/331 |
| 1,857,106 | 5/1932 | Bishop | 248/393 |
| 2,143,098 | 1/1939 | Wohlk | 297/343 |
| 2,182,598 | 12/1939 | Owler | 297/343 |
| 2,774,644 | 12/1956 | Patterson | 312/331 |
| 3,178,248 | 3/1965 | Bridwell | 312/331 |
| 3,282,626 | 11/1966 | Hampton | 297/89 |
| 3,572,823 | 3/1971 | Hampton | 297/85 |
| 3,758,151 | 9/1973 | Re | 297/83 |
| 3,858,932 | 1/1975 | Crum et al. | 297/85 |

FOREIGN PATENT DOCUMENTS

| | | | |
|---|---|---|---|
| 1,109,616 | 9/1955 | France | 254/10.2 |
| 564,868 | 10/1944 | United Kingdom | 248/395 |

*Primary Examiner*—James T. McCall

*Attorney, Agent, or Firm*—Wood, Herron & Evans

[57] ABSTRACT

An improved control assembly for a reclining chair of the type having a body support, i.e., a seat and a backrest, adapted to move between an upright position and a reclining position. The body support is pivotally mounted on a body support frame, the body support frame being carried on a stationary chair base by roller and track means to permit forward/rearward motion of the body support frame relative to the chair base. The improved control assembly is in the nature of a control linkage positioned beneath the chair's seat, the control linkage being hidden from view in the upright and all reclining positions of the chair. The improved control linkage is connected between the chair base and the body support frame so as to control sliding movement of the body support frame in going between upright and reclined positions.

29 Claims, 14 Drawing Figures

CONTROL ASSEMBLY FOR A RECLINING CHAIR

This invention relates to reclining chairs. More particularly, this invention relates to the linkage assemblies by which a reclining chair is translated between upright and reclining positions.

The prior art reclining chair includes a body support comprising a seat and a backrest. The body support is mounted on a stationary base for movement between an upright position and a reclining position. The reclining chair may also include a leg rest in front of the chair's seat which is movable between a vertical storage position and a horizontal use position. In one common type of reclining chair, the chair's seat and backrest reclines from an upright position to a intermediate reclining position during a first phase of movement, and from that intermediate position to a final reclining position during a second phase of movement. In this common type of reclining chair, the leg rest is normally moved to the horizontal use position during the first phase of movement so that the leg rest is fully extended in the intermediate reclining position. The leg rest and the chair's body support then move substantially as one fixed unit during the second phase of movement as the seat and backrest move from the intermediate reclining position to the final reclining position. A typical such reclining chair is shown in U.S. Pat. No. 3,282,626.

One major disadvantage encountered with reclining chairs of this general description is that the chair's backrest pivots downwardly and rearwardly (as the seat and backrest pivot from the upright to the reclining position) to a full reclining position in which the headrest or top portion of the backrest extends aft of its upright position. Consequently, the reclining chair must be disposed a substantial distance out from a wall or other obstruction which might be adjacent thereto so as to provide sufficient space to permit the seat and backrest to be moved to the full reclining position. The space which must be provided between the backrest of the reclining chair and a wall, for example, is therefore useless or waste space when the reclining chair is in the upright position. Furthermore, and as a practical matter, it is not always convenient or permissible to provide such waste space; in such instances a reclining chair is not used, or if one is used its functional ability to move to a reclining position is wasted.

A reclining chair of the type which may be moved from an upright to a full reclining position without the provision of any space behind the chair for rearward movement of the backrest is known to the prior art. Such a reclining chair, which may be moved from an upright to a full reclining position without any substantial rearward or aft movement of the headrest or top portion of the chair's backrest, is illustrated and described in U.S. Pat. No. 3,858,932. The reclining chair shown in that patent mounts the chair's body support on a body support frame movably attached to a stationary chair base so that the chair's seat and backrest may move forwardly on the chair base while the seat and backrest are tilted into the full reclining position. The length of forward motion of the body support on the chair base is correlated through a control assembly with the location of the backrest in the full reclining position, thereby resulting in little or no space being required behind the backrest to allow for the body support's reclining movement. The control assembly interconnects the stationary chair frame and the body support's backrest, and basically includes an extended length strut/track structure that stretches from the chair base along the outside edges of the backrest on each side thereof up adjacent to the backrest's headrest portion.

The control assembly for a reclining chair, as shown and described in U.S. Pat. No. 3,858,932, performs the function for which it is designed quite well. However, that control assembly must interconnect the body support's backrest with the stationary chair frame on each side thereof as the extended length strut/track structure of the control assembly extends upwardly along the outside edges of the backrest. This requires the backrest to be provided with wings, as such are known in the chair trade, to enclose or hide that control assembly's structure. Such wings provide increased manufacturing costs, thereby increasing the retail cost of the chair to the consumer.

Accordingly, it has been one objective of this invention to provide an improved control assembly for a reclining chair of the type having a body support pivotally mounted on a body support frame which is movably carried on a stationary chair frame, the improved control assembly functioning to prevent substantial rearward movement of the body support's backrest relative to the stationary base as the body support moves between the upright position and the reclining position.

It has been a further objective of this invention to provide an improved control assembly for a reclining chair of the type having a body support pivotally mounted on a body support frame which is movably carried on a stationary chair frame, the improved control assembly being disposed entirely beneath the chair's seat in the upright and in all reclining positions of the chair, the control assembly thereby being hidden from an observer's view in the upright and all reclining positions of the chair.

It has been another objective of this invention to provide an improved control assembly for a reclining chair of the type having a body support pivotally mounted on a body support frame which is movably carried on a stationary chair frame, the improved control assembly being directly connected by connector linkage between the stationary chair frame and a recliner linkage assembly carried on the body support frame.

In accord with these objectives, the structure of this invention is directed to an improved control assembly for a reclining chair of the type having a body support, i.e., a seat and backrest, adapted to move between an upright position and a reclining position. The body support is pivotally mounted on a body support frame, the body support frame being carried on a stationary chair base by roller and track means to permit forward/rearward motion of the body support frame relative to the chair base. The improved control assembly is in the nature of a control linkage positioned beneath the chair's seat, the control linkage being hidden from view in the upright and all reclining positions of the chair. The improved control linkage is directly connected by connector linkage between the chair base and a recliner linkage assembly fixed to the body support frame and body support.

Other objectives and advantages of this invention will be more apparent from the following detailed description taken in conjunction with the drawings in which.

Figure 3:
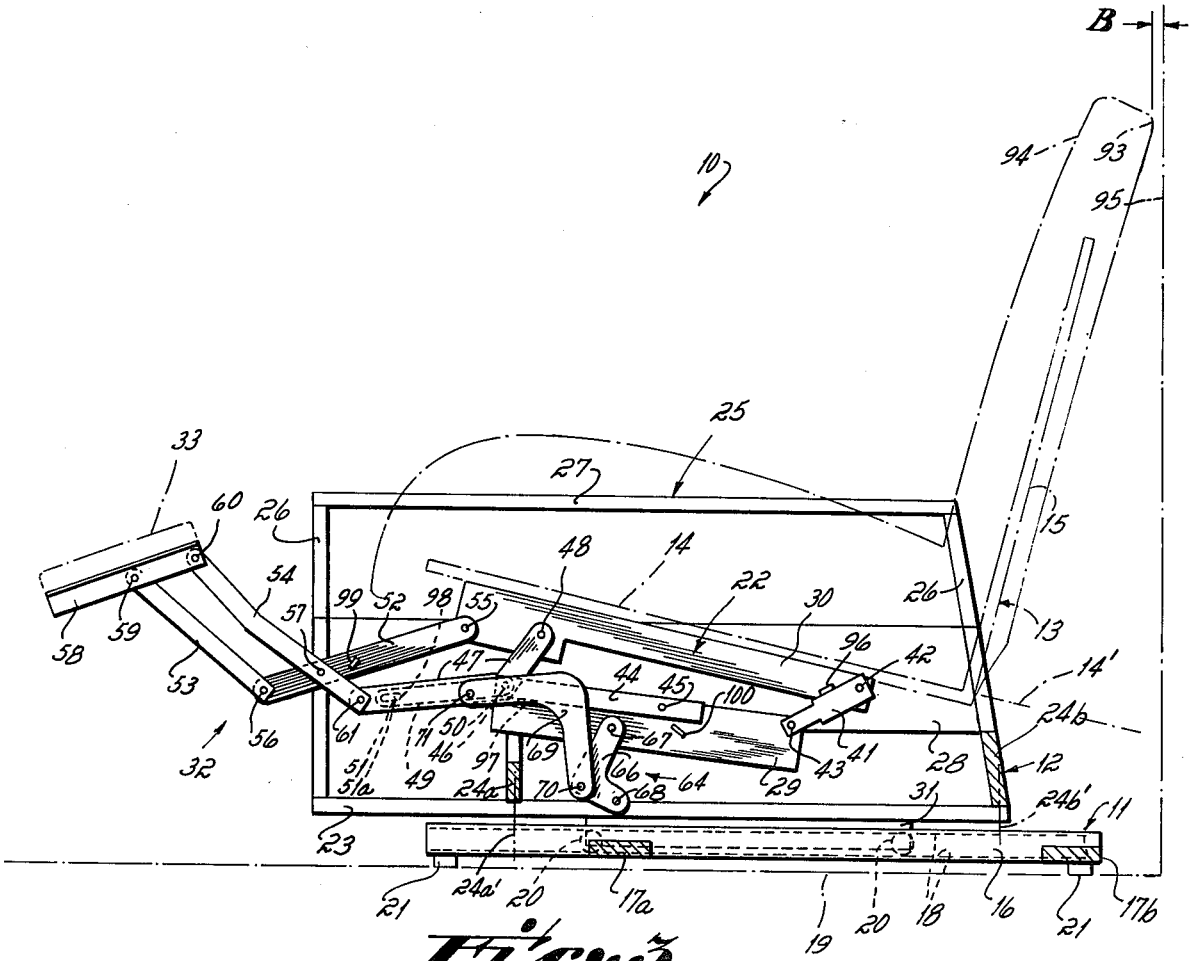
FIG. 3 is a side view similar to FIG. 1 but showing the reclining chair in the intermediate reclining or T.V. position with the chair's leg rest extended.
Figure 4:
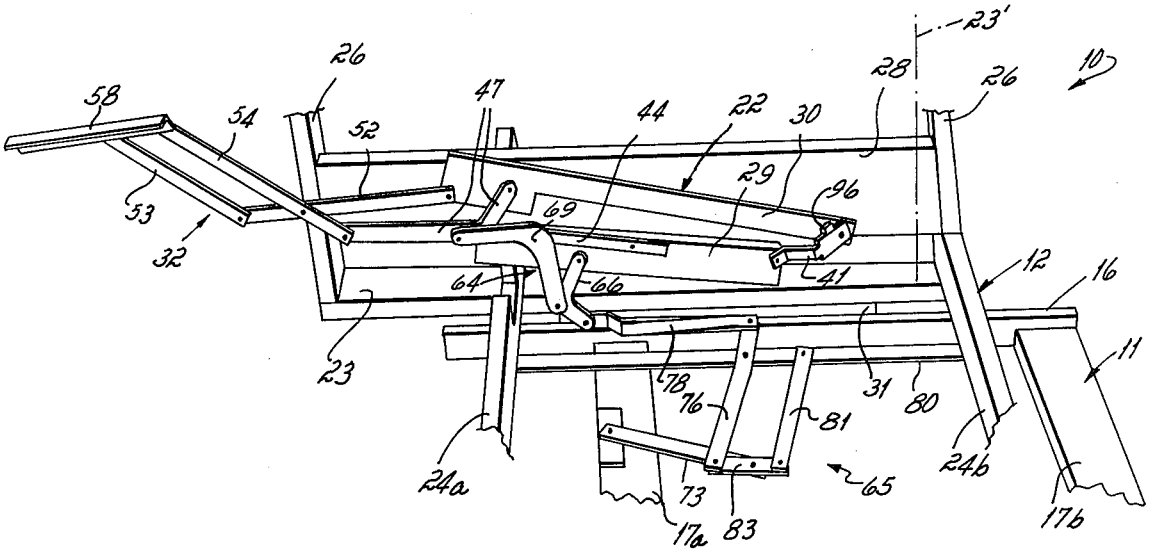
FIG. 4 is a view similar to FIG. 2 but showing the first embodiment of the improved control assembly in that operational attitude where the reclining chair is in the same intermediate reclining position as shown in FIG. 3.
Figure 5:
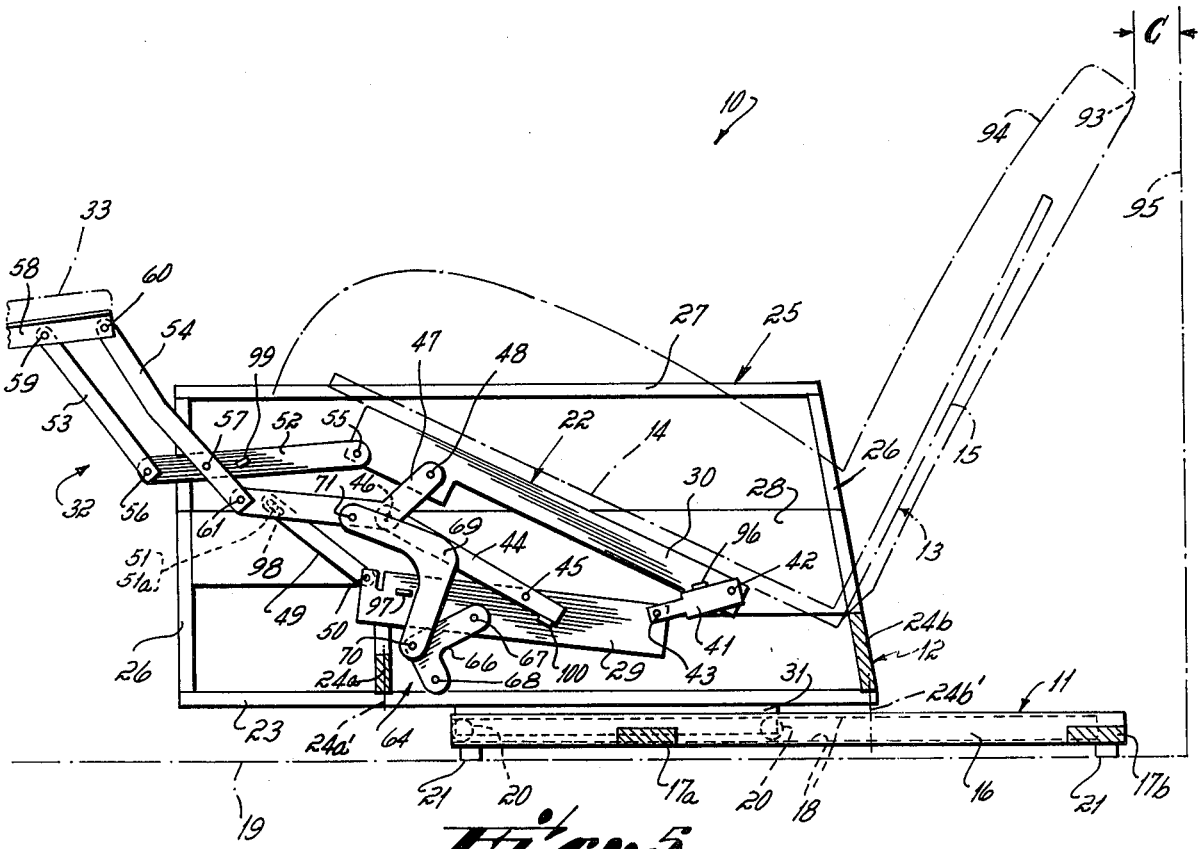
FIG. 5 is a side view similar to FIGS. 1 and 3 but showing the reclining chair in the full reclining position.
Figure 6:
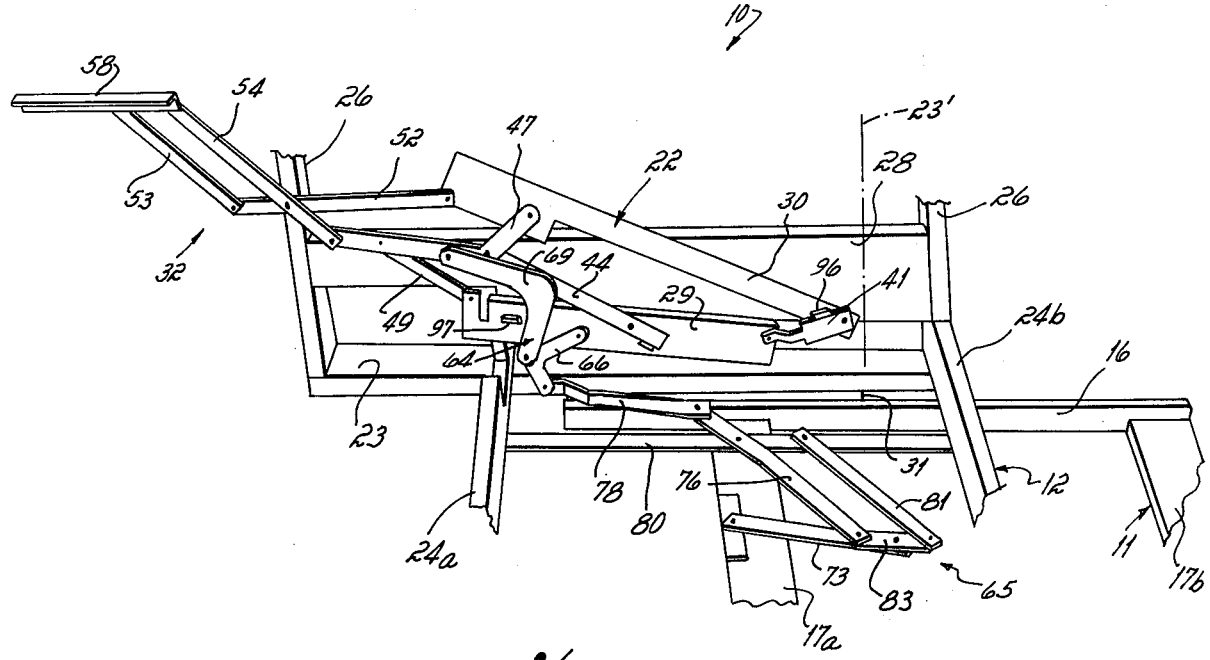
FIG. 6 is a view similar to FIGS. 2 and 4 but showing the first embodiment of the improved control assembly in that operational attitude where the reclining chair is in the same full reclining position as shown in FIG. 5.
Figure 12:
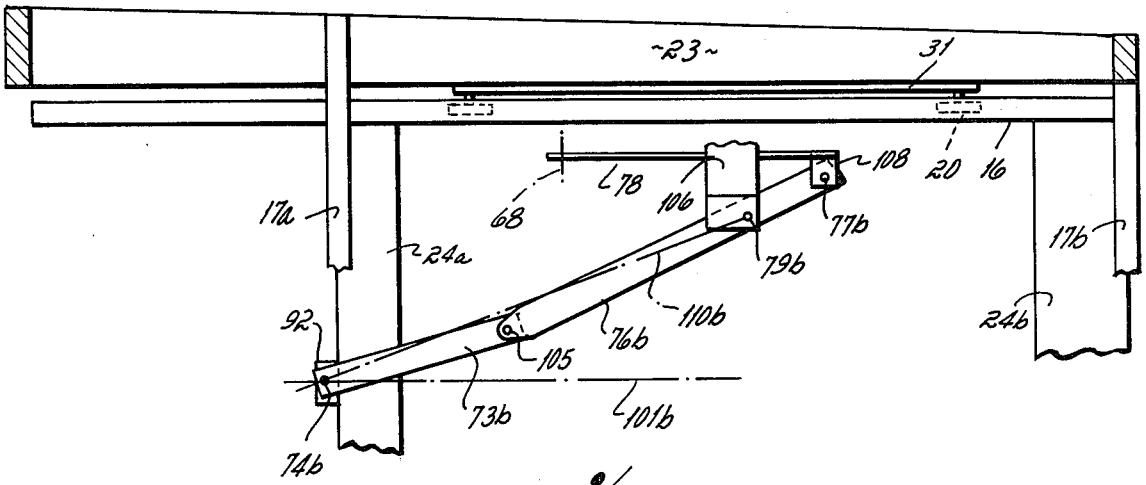
FIG. 12 is a top view showing the third embodiment of the improved control assembly when the reclining chair, and the recliner linkage assembly, is in the upright or FIGS. 1 and 11 attitude.
Figure 13:
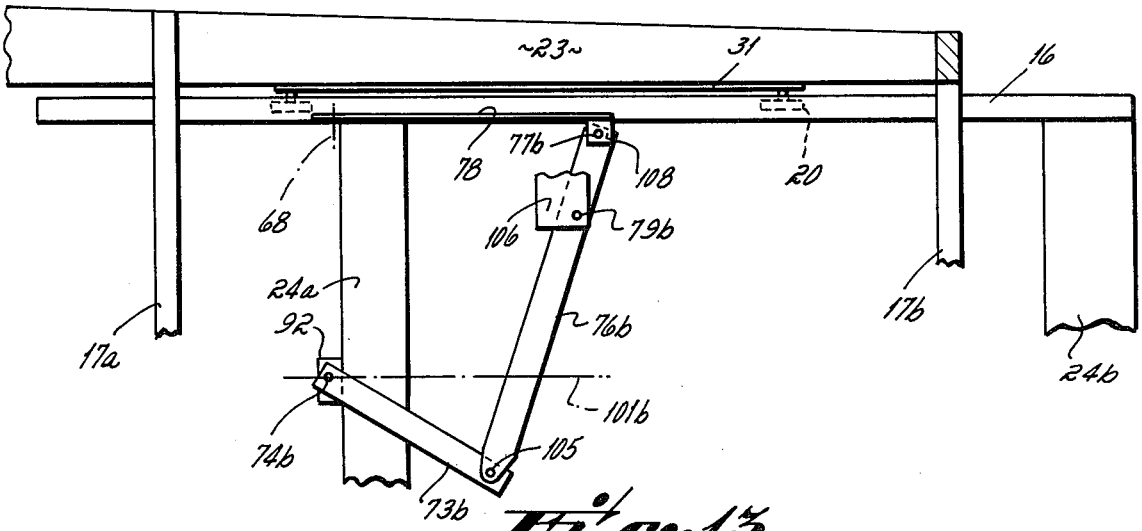
Figure 14:
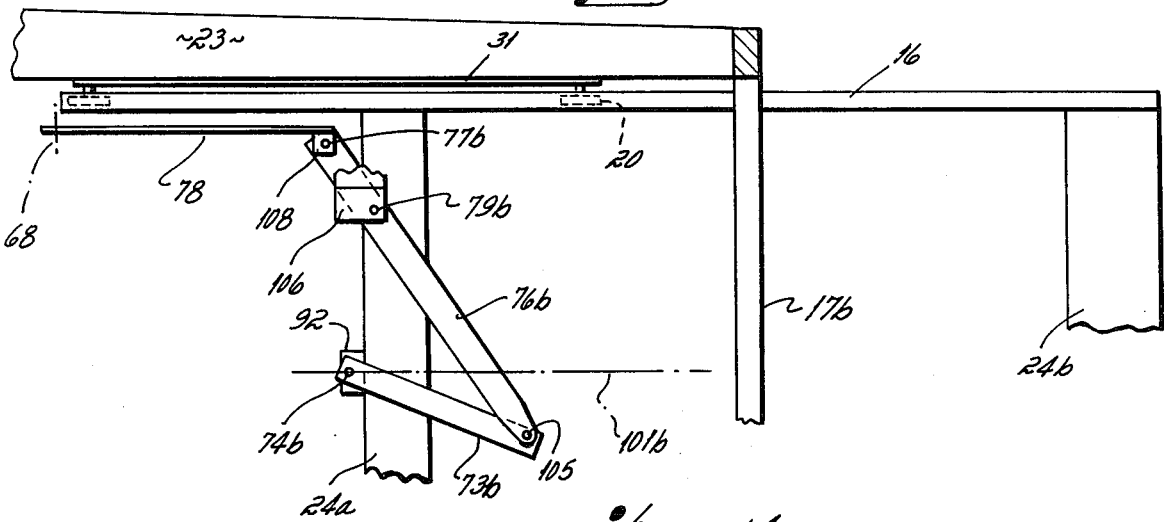

FIG. 13 is a top view similar to FIG. 12 but showing the third embodiment of the improved control assembly when the reclining chair, and the recliner linkage assembly, is in the intermediate reclining or FIG. 3 attitude; and FIG. 14 is a top view similar to FIGS. 12 and 13 but showing the third embodiment of the improved control assembly when the reclining chair is in the full reclining or FIG. 5 attitude.

The reclining chair 10 basically includes a stationary chair base 11 and a body support frame 12 mounted for sliding movement on the stationary base. A body support 13, including seat 14 and backrest 15, is pivotally mounted in the body support frame 12 by recliner linkage assembly 22. The recliner linkage assembly 22 illustrated in the Figures is found on each side of the chair even though the structure for only one side is shown. In other words, the recliner linkage assembly 22 is duplicated on opposed sides of the chair (only one side being shown in the drawings for purposes of illustration) each recliner linkage assembly connecting the base 11 and body support frame 12 on each side of the chair. Further, and although the figures only show the framework for the body support frame 12 and body support 13, it will be understood that such framework is suitably adapted for receiving appropriate spring elements, cushioning, upholstery, or the like for completion of a saleable product, i.e., the springs, cushioning and covering of the chair have been eliminated for clarity of illustration of the improvement of this invention.

The stationary chair base 11 includes parallel and spaced side rails (one of which is shown at 16) which are interconnected by front and rear cross rails 17*a*, 17*b*. Tracks 18 (one of which is shown), parallel to floor 19, are mounted in fixed relation to the outside of the base's spaced side rails 16, the tracks being adapted to receive rollers 20 fixed on each of spaced side rails 23 which are part of body support frame 12, thereby mounting the body support frame 12 in movable or slidable relation relative to the chair base 11. Four legs 21 (two of which are shown) are disposed at the four corners of the chair base 11 to support the base above floor 19 level.

The body support frame 12, as previously mentioned, provides the pivotal mount base for the body support 13. The body support frame 12 itself includes parallel and spaced side rails (one of which is shown at 23) which are interconnected by front 24*a* and rear 24*b* cross rails 24. An armrest frame 25 extends vertically upward from each of the body support frame's side rails 23. Each armrest frame 25 includes generally vertically extending front and rear armrest post 26 fixed at their bottom ends to a side rail 23 and interconnected at their top end by an armrest rail 27. A longitudinal brace member 28 is interconnected between the front and rear armrest posts 26 approximately midway, top to bottom, of each armrest frame 25. Each armrest frame 25 is adapted to receive padding and covering, not shown, to provide a salable chair.

The body support 13 includes the seat 14 and backrest 15, both of which may be in the nature of framework adapted to receive springs, cushioning, and covering, not shown, to provide a salable chair. The body support 13 is connected to the body support frame 12, on each side thereof, through a recliner linkage assembly 22. Mount plate 29 of each recliner linkage assembly 22 is fixed to the adjacent armrest brace member 28, and the chair's seat 14 is connected to the adjacent body support plate 30 of each recliner linkage assembly 22, thereby pivotally connecting the body support 13 to the body support frame 12. Front and rear rollers 20 are fixed to a roller plate 31 that depends from and is fixed to the underside of each of the body support frame's side rails 23, those rollers being received within tracks 18 fixed to the chair base 11, thereby permitting the forward/rearward motion of the body support frame 12 relative to the chair base as previously mentioned. Thus, the armrests 25, body support 13 and body support frame 12 are all movably supported on the stationary chair base 11 by rollers 20 within the chair base's track 18, thereby permitting forward and rearward movement of the body support frame 12 and those of the chair's structural elements connected to it.

Figure 1:
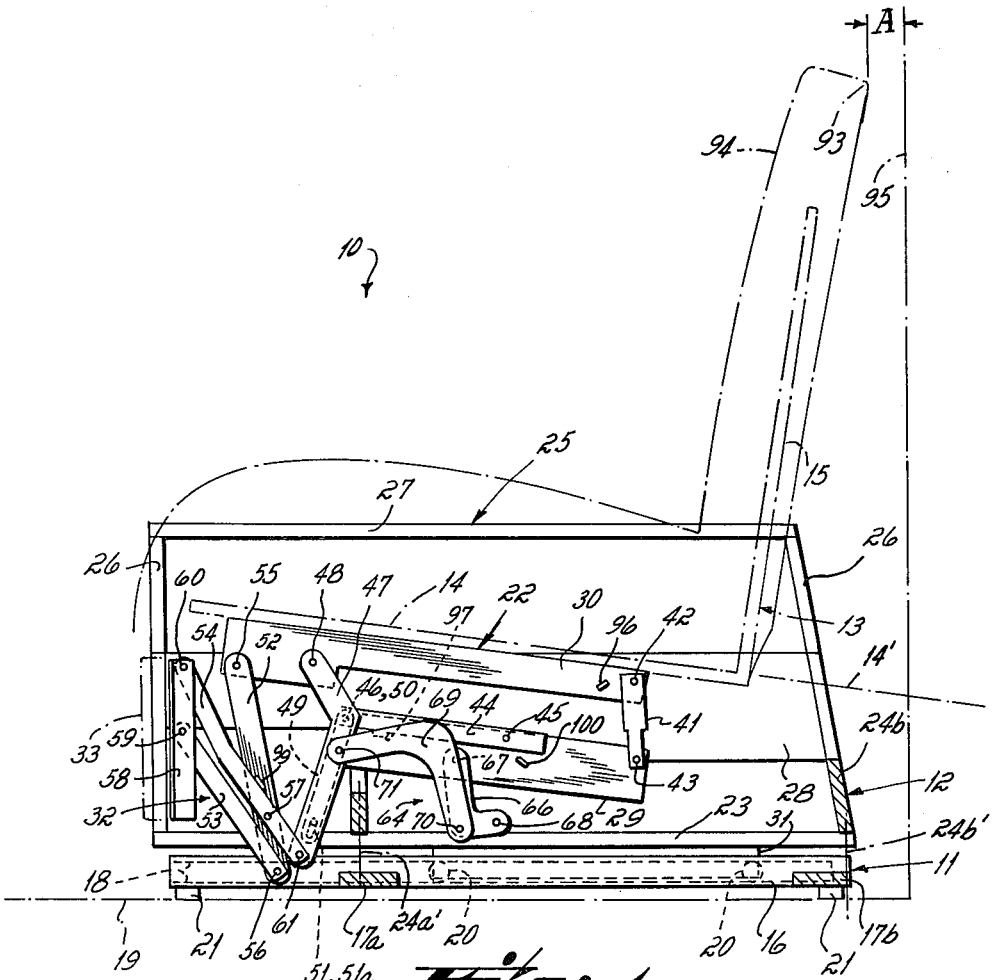
FIG. 1 is a side view illustrating a recliner linkage assembly and a leg rest linkage assembly for a reclining chair having an improved control assembly structured in accord with the principles of this invention, the reclining chair being shown in the upright attitude.
Figure 2:
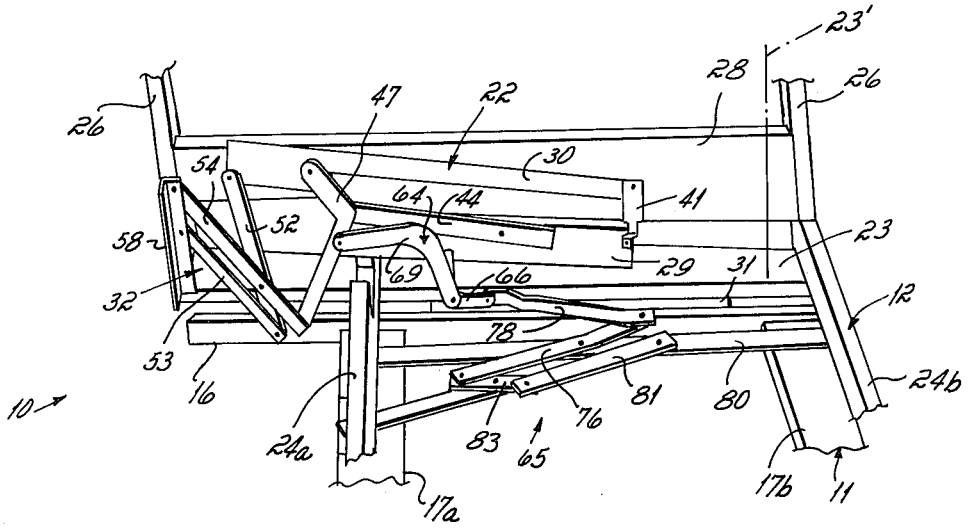
FIG. 2 is a perspective view illustrating a first embodiment of the improved control assembly in structural relation with the recliner linkage assembly, and in the same upright attitude as shown in FIG. 1.

The recliner linkage assembly 22 for the body support 13, and leg rest linkage assembly 32 for a leg rest (shown in phantom lines as at 33) are operatively connected together, and are known per se to the prior art. The combined recliner 22 and leg rest 32 linkage means operatively interconnects the chair's movable body support frame 12 with its body support 13 for moving the body support from an upright position (as shown in FIG. 1) to an intermediate reclining or T.V. position (as shown in FIG. 3) to a full reclining position (as shown in FIG. 5), and operatively interconnects the leg rest 33 with the body support frame 12 and body support 13 for moving the leg rest from a vertical storage position (as shown in FIG. 1) to a horizontal use position (as shown in FIGS. 3 and 5). The body support frame 12, and, hence, the armrests 25 moves forwardly relative to the base 11 as the body support 13 moves from the upright position shown in FIG. 1 to the full reclining position shown in FIG. 5, and moves rearwardly relative to the chair base as the body support moves from the full reclining position to the upright position.

Each recliner linkage assembly 22 includes the body support plate 30 attached to the seat 14, and the mounting plate 29 attached to an adjacent armrest's brace member 28. An intermediate tilt link 41 is pivotally connected at its upper end to the body support plate 30 as at 42, and is pivotally connected at its lower end to the mount plate 29 as at 43. A tilt limit link 44 is pivotally connected toward, but not at, its rear end as at 45 to the mount plate 29 and is pivotally connected at its front end as at 46 to a locater link 47 at a position between the ends of that link 47. The locater link 47 is pivotally connected as at 48 to the body support plate 30 at its upper end. A lock link 49 is pivotally connected to the mount plate 29 at one end as at 50, and receives stud 51 (fixed to locater link 47 toward the end thereof opposite pivot 48 and beyond pivot 46) in lost motion slot **51*a*** at its other end.

Each leg rest linkage assembly 32 is in the form of a double V lazy tong linkage of the conventional overlapped V-type. The leg rest linkage 32 includes lower extension of the locater link 47, and links 52–54. These links 47, 52–54 are arranged so that links 52 and 53 form one V, and so that links 47 and 54 form another V. The link 52 is pivotally connected at one end to body support plate 30 as at 55, is pivotally connected at the other end to link 53 as at 56, and has a mid-portion pivotally connected to the crossing link 54 as at 57. The links 53 and 54 are pivotally connected to leg rest frame 58, as at 59 and 60, respectively. The leg rest frame 58 supports leg rest 33. The link 54 is pivotally connected intermediate its ends to the link 52 as at 57, and is pivotally connected at its lower end to the bottom of locater link 47 as at 61.

The recliner linkage 22 and leg rest linkage 32 assemblies are, as previously mentioned, carried by and mounted to the body support frame 12 and body support 13 as shown in FIGS. 1, 3 and 5. The recliner linkage assembly 22 is directly connected with the stationary chair base 11 through actuator linkage assembly 64 and control linkage assembly 65. Thus, recliner linkage assembly 22, actuator linkage assembly 64, and control linkage assembly 65 are all directly connected in series one with the other.

The actuator linkage assembly 64 is mounted on the body support frame 12. The elements of the actuator linkage assembly 64 include bellcrank 66 pivotally mounted at one end as at 67 to the mount plate 29, and pivotally mounted at the other end as at 68 to control linkage assembly 65. The actuator linkage assembly 64 also includes a substantially right angle configured arm 69 pivotally connected at one end as at 70 to the elbow of the bellcrank 66, and pivotally mounted at the other end as at 71 to the locater link 47 between pivot points 46 and 61 on that link 47. A first embodiment 65 of the control linkage assembly is particularly illustrated in FIGS. 2, 4, 6–9; a second embodiment **65*a* of the control linkage assembly is illustrated in FIG. 10; and a third embodiment 65 of the control linkage assembly is illustrated in FIGS. 11–14. All three embodiments use bellcrank 66 and angle arm 67 of actuator linkage assembly 64 in series to interconnect directly with the recliner linkage assembly 22**.

Figure 7:
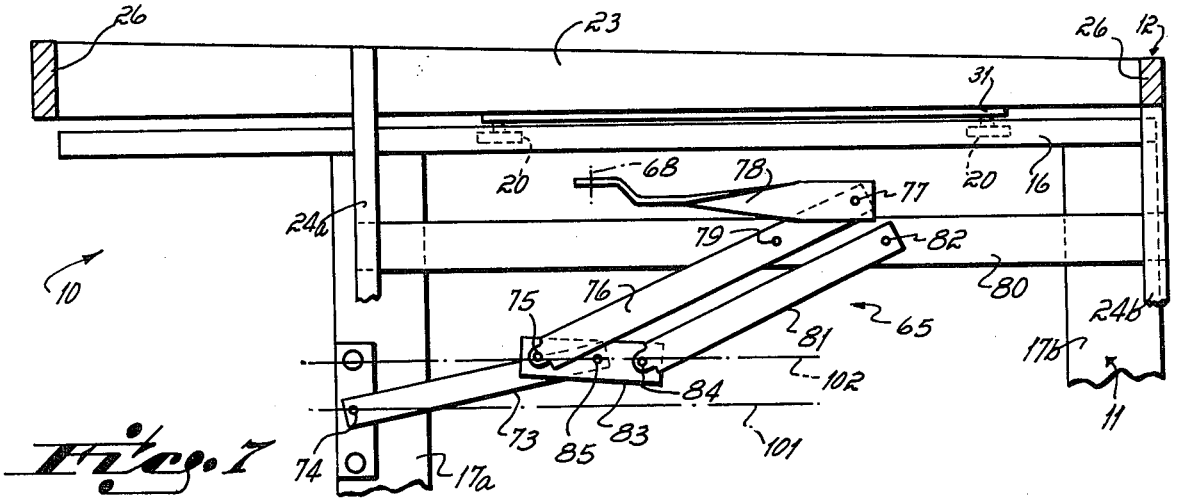
FIG. 7 is a top view showing the first embodiment of the improved control assembly when the reclining chair is in the upright or FIG. 1 attitude.
Figure 8:
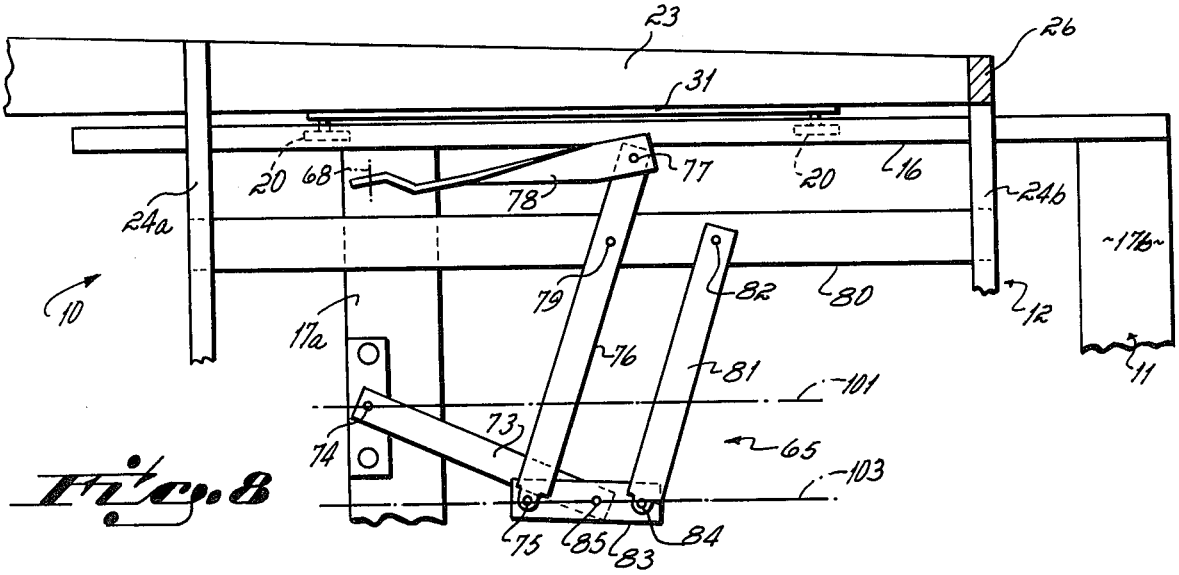
FIG. 8 is a top view similar to FIG. 7 but showing the first embodiment of the improved control assembly when the reclining chair is in the intermediate reclining or FIG. 3 attitude.
Figure 9:
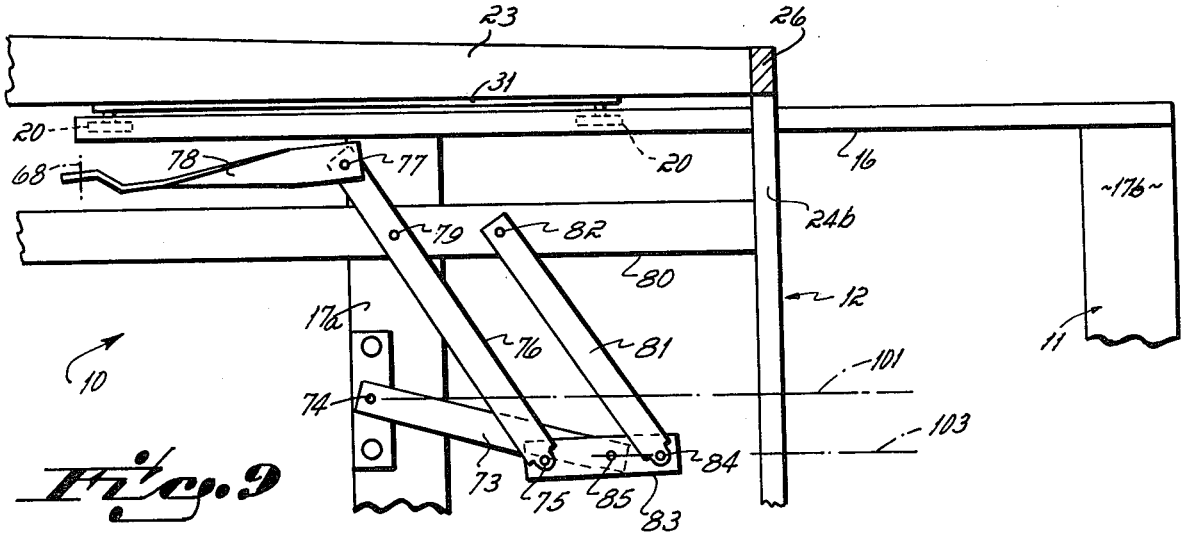
FIG. 9 is a top view similar to FIGS. 7 and 8 but showing this first embodiment of the improved control assembly when the reclining chair is in the full reclining or FIG. 5 attitude.
Figure 10:
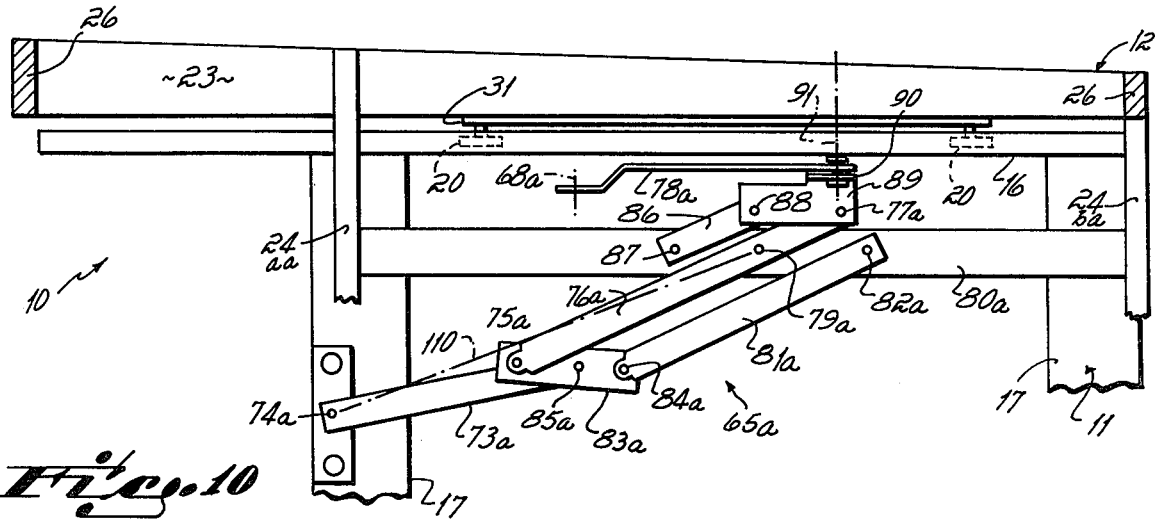
FIG. 10 is a top view similar to FIG. 7 but showing a second embodiment of the improved control assembly when the reclining chair is in the upright attitude shown in FIG. 1.

The first embodiment of the control linkage assembly 65, as shown in FIGS. 7–9, primarily includes a swing link 73 pivotally connected at one end as at 74 to the front cross frame member **17*a* of the chair frame 11, and pivotally connected at the other end as at 85 to the mid-point of a cross link 83. A control link 76 is pivotally connected as at 75 to one end of the cross link 83 and is pivotally connected at the other end as at 77 to the actuator linkage assembly 64 through connecter link 78. The control link 76 is pivotally connected intermediate its ends as at 79 to a longitudinal brace member 80 mounted in fixed location to and between front and rear cross members 24*a*, 24*b* of the body support frame 12. The control linkage assembly 65 preferably is in the nature of a parallelogram linkage having primary control link 76 and secondary control link 81. The primary control link 76, as previously mentioned, is pivotally connected intermediate its ends as at 79 to chair frame's brace member 80, and the secondary control link 81 is pivotally mounted at one end as at 82 to that same brace member 80. The movable cross link 83 pivotally connects the other ends of the primary 76 and secondary 81 control links one to the other as at 75 and 84, and that movable cross link 83 is itself pivotally connected to one end of the swing link 73 as at 85 intermediate the ends of the movable cross link. The connecter link 78 is pivotally connected on a vertical pivot axis at one end to the other end of the primary control link 76 as at 77, and is pivotally connected to the bellcrank 66 at the other end as at 68 on a horizontal pivot axis, thereby directly connecting the parallelogram control linkage assembly 65 in series with the actuator linkage assembly 64 and the recliner linkage assembly 22**.

It is the direct series connections of actuator 64 and control 65 assemblies between the chair base 11 and the recliner linkage assembly 22 that directly connects the chair base with the recliner linkage assembly. Note, as illustrated particularly in FIGS. 2, 4, and 6 that the control linkage assembly 65 is positioned fully beneath the seat 14 of the chair's body support 13 and, indeed, is positioned within a space defined (a) by phantom vertical planes **24*a*′, 24*b*′ defined by front 24*a* and rear 24*b* cross rails of the chair's movable support frame 12, (b) by phantom vertical planes which include said body support frame's side rails (only one side rail phantom vertical plane 23′ being shown), (c) by the floor 19 on which the chair rests, and (d) by a phantom plane 14′ which includes the chair's seat 14. This orientation of the control assembly 65 is the case whether the chair is in the upright FIG. 1 position, the intermediate reclining FIG. 3 position, or the full reclining FIG. 5 position. Note also that all pivotal connections 74, 75, 77, 79, 82 and 84 of the control linkage assembly 65 are on substantially vertical axes; such permits the control linkage assembly 65 to be fabricated as a generally planar structure and, importantly, permits that assembly 65 to be oriented and positioned in a generally horizontal plane beneath the seat 14 of the body support 13 as previously mentioned. Thus, the control linkage 65 is hidden from an observer's view when the chair 10** is viewed from the front, top, or either side, and whether the chair is in the upright (see FIG. 1), intermediate reclining (see FIG. 3), or full reclining (see FIG. 5) position.

In preferred form, the various lengths of the links 73, 76, 81 of control linkage assembly 65 of this invention are sized relative one to the other, and are pivotally connected to body support frame 12 and chair base 11 at pivot axes 79, 82 and 74, in such a manner that permits the body support frame to move an overall distance between its upright and reclining position limits which is about three times as great as the distance which connector axis 77 of the primary control link moves relative to the body support frame. Of course, connector axis 77 interconnects the control linkage assembly with the actuator assembly 64. It is this mechanical advantage feature of the control linkage assembly 65 that permits the linkage to be positioned fully beneath the seat 14 in all of the upright and reclining positions of the chair. These multiple advantages are also inherent in the second 65*a* and third 65*b* embodiments discussed below.

It is important, also, to note that only one control linkage assembly 65 is required for the chair 10 shown in FIGS. 1–9. In other words, a recliner linkage assembly 65 is provided to cooperate with one of the recliner linkage assemblies on one side only of the chair; a control linkage assembly 65 is not required on each side of the chair to cooperate with the recliner linkage assembly 22 located on each side of the chair. This is also the case with the second embodiment 65*a* of the control linkage assembly discussed immediately below, but is not the case with the third embodiment 65*b* also discussed in detail below.

The second embodiment 65*a* to the control linkage assembly is illustrated in FIG. 10. The alternative embodiment retains the same basic swing link 73*a*, primary control link 76*a*, secondary control link 81*a*, movable cross link 83*a*, and brace member 24*a*, 24*al*, 80*a* construction of the first control linkage assembly 65 embodiment. However, the second control linkage assembly 65*a* embodiment includes an alignment link 86 disposed parallel to the primary 76*a* and secondary 81*a* control links, the alignment link 86 being pivotally mounted at one end as at 87 to the brace member 80*a*. The alignment link 86 is also pivotally mounted at its other end as at 88 to a connecter plate 89, the other end of the primary control link 76*a* is also pivotally mounted to that plate 89 at at 77*a*. The connecter link 78*a* in this embodiment is also pivotally mounted to the connecter plate 89, but is pivotally mounted to plate's vertical ear 90 on a horizontal pivot axis 91 separate from axis 77*a* (the axis 91 being horizontal relative to the vertical pivot axis of the similar interconnection point 77 with the parallel linkage control assembly 65 in the first embodiment). This second embodiment 65*a* of the control linkage structure permits a greater degree of backward or reclining tilt for the body support 13 under certain structural circumstances because of the horizontal pivot axis 91 of the connecter link 78*a* at its interconnection with the parallel linkage portion 76*a*, 81*a*, 86 of the control linkage structure 65*a*. Further, the presence of the alignment link 86 provides a sturdier structure and, under certain structural circumstances, permits greater mounting flexibility for the longitudinal mounting location of the control linkage structure 65*a* relative to the forward/backward travel path of the body support frame 12.

In use, and when a user is seated in the reclining chair, it may be activated in a two-step sequence from the upright position illustrated in FIG. 1 to an intermediate reclining or T.V. position illustrated in FIG. 3 and then to a full reclining position illustrated in FIG. 5. In translating the chair between the FIG. 1, 3 and 5 positions, the improved control linkage assembly 65 of this invention functions to maintain the aftmost edge 93 of the chair's headrest portion 94 outwardly away from a wall 95 against which the chair 10 may be positioned, i.e., prevents the chair's backrest from tilting backwardly into the wall and thereby prevents that wall from impeding the reclining action of the chair's body support 13. Note that gap A is provided between the headrest 94 and wall 95 when the chair 10 is upright as shown in FIG. 1, gap B is provided when the chair is in an intermediate reclining position, the gap C (of similar width to gap A) is provided when the chair is in the full reclining position.

With a user seated in the reclining chair 10, and to translate the chair from the FIG. 1 attitude to the FIG. 3 attitude, the user pushes forward on the chair's armrests 25 and, hence, backward against the chair's backrest 15. The force reaction between the armrests 25 and backrest 15 causes the body support to pivot about pivot points 42, 43 defined by the pivotal connections of the intermediate tilt link 41 with the mount plate 29 and the body support plate 30 until the intermediate tilt link abuts against stop 96 on the body support plate, thereby locating the body support 13 in the intermediate reclining position. This force reaction between the armrests 25 and backrest 15 also activates the double V lazy tong leg rest linkage 32 to extend the leg rest frame 58 from a vertical storage or upright position. (as so located by stop 99 on link 52) into the intermediate position shown in FIGS. 3 and 4. The force reaction between the chair's armrests 25 and backrest 15 also induces forward motion of the body support frame 12 on the stationary frame 11. The forward motion of the body support frame 12 on the stationary frame 11 is controlled by the control linkage 65. Such occurs because the control linkage 73, 76, 81, 83 (plus alignment link 86 and connector plate 89 in the second embodiment 65*a*) is translated from the FIG. 2 upright to the FIG. 4 intermediate attitude through the bellcrank 66 and angle arm 69, the control linkage 65 thereby functioning to limit and define the forward motion extent of the body support frame 12 on the chair base 11.

As the leg rest frame 58 is extended from the FIG. 1 to the FIG. 3 attitude the body support 13 is prevented from further reclining movement (after the intermediate tilt link 41 abuts stop 96) by the lock link 49 because the lock link maintains tilt limit link 44 in seated relation on top 97 during extension of the leg rest linkage 32. Such is accomplished because stud 51 on the locater link 47 abuts against end 98 of the pivotal lock link's lost motion slot 51*a* to prevent further tilting motion of the body support plate 30 (and, thereby, to prevent further reclining motion of the body support 13 itself), during the FIG. 1 to FIG. 3 reclining step. Note that, in the FIG. 1 to FIG. 3 step, the body support frame 12 has moved forward relative to the chair frame 11 a distance sufficient to maintain the gap B between the chair's headrest 94 and the wall 95. The FIG. 3 attitude is generally known as the TV attitude in that the leg rest 33 and body support 13 positions shown in that Figure are considered ideal by some users for viewing television.

When the reclining chair is to be reclined further from the FIG. 3 to the FIG. 5 attitude, such as might be done when the chair is to be used by the user for taking a nap, the user pushes again on the chair's armrests 25 and leans back on the backrest 15. Such causes the body support plate 30 and, hence, the seat 14 and backrest 15, to pivot clockwise about now fixed pivot point 43 until the tilt limit link 44 abuts stop 100 on the mount plate 29. Leg rest frame 58 is moved slightly upward as the body support 13 is tilted rearward during motion from the intermediate to full reclining position, but the leg rest frame is maintained in its fixed relation via-a-vis the body support plate 30 because lock link 49 is no longer retained in parallel or lock relation with locater link 47, i.e., because locater link stud 51 moves out into the lock link's lost motion slot 51*a*. This further pivoting of the body support 13 about pivot point 43 causes the body support frame 12 to move forward once again relative to the stationary chair frame 11, the forward motion of the frame 12 again being limited and defined by linkage 73, 76, 81, 83 (plus alignment link 86 and connecter plate 89 in the second embodiment 65*a*) as actuated through the bellcrank 66 and angle arm 69. As was the case with the tilting motion of the body support 13 from the FIG. 1 to the FIG. 3 attitude, and as is the case with the tilting motion of the body support from the FIG. 3 to the FIG. 5 attitude, a clearance gap C is maintained between the aftmost edge 93 of the headrest 94 and the wall 95 through the control linkage assembly 65. In a sense, therefore, the motion of the swing link 73 and the primary control link 76 in the control linkage assembly 65 is actuated by the extension/retraction motion of the recliner linkage 22 and the leg rest linkage 32, and the control linkage then, in turn, controls the position of the backrest's aft edge 93 vis-a-vis the wall 95 because same controls the forward/rearward position of the body support frame 12 vis-a-vis the stationary frame 11. The secondary control link 81 and movable cross link 83 function to control the motion of the primary control link 76 and the swing link 73 as the body support frame 12 is reciprocated relative to the stationary frame 11 so that the primary control link and swing link do not get out of operational alignment, i.e., so that the control linkage assembly does not become locked up in either the full extended or full retracted attitude of the body support frame relative to the stationary frame. Further, note that the pivotal connection 85 of the swing link 73 with the parallel control links 76, 81 moves over center between the upright and reclining positions of the chair relative to the longitudinal motion path of the frames 11, 12 and relative to a longitudinal axis 101 that passes through pivot connection 74 of the control assembly with the stationary frame. As shown in FIGS. 7 and 8, and when the frames 11, 12 are in the retracted attitude (and, hence, the chair 10 is in the upright attitude), that pivotal connection is in a longitudinal center line 102 to one side of the swing link's pivotal connection 74 with the frame 11. When the frames 11, 12 are either intermediately or fully extended (and, hence, the chair is in the reclining position), that pivotal connection 85 is in a longitudinal centerline 103 on the other side of the pivotal connection 74 between the swing link 73 and the stationary frame 11. This over-center action of the control linkage assembly 65 vis-a-vis its interconnection with the stationary frame tends to restrain the chair in the upright position vis-a-vis the reclining positions, and in the reclining positions vis-a-vis the upright position.

The third embodiment 65*b* of the improved control linkage assembly is illustrated particularly in FIGS. 11–14. As shown particularly in FIG. 11, the improved control linkage assembly 65*b* is adapted to be used in apairs 65*b*', 65*b*'' with a reclining chair, one control assembly being disposed on each side of the chair. In other words, one control assembly 65*b*' is connected between the chair's base frame 11*b* and a recliner linkage assembly 22*b* on one side of the chair, and an identical and second control linkage assembly 65*b*'' is also connected between that base frame and a recliner linkage assembly on the other or opposite side of the chair. Note that the third embodiment of control linkage 65*b* is more simplified, i.e., comprises less structural elements, than the parallelogram linkage structures of first 65 and second 65*a* embodiments. An important feature of the third embodiment 65*b* of the control linkage assembly, when two of same are used on opposed sides of the chair in combination with opposed recliner linkage assemblies 22*b*, is that the operational stability of the chair is increased. Further, the third embodiment 65*b* structure causes less wear on the recliner linkage 22*b* and on the roller/track mechanisms, vis-a-vis use of only a single control linkage 65 or 65*a* in functional combination with only one recliner linkage 22 on only one side of the chair, in that no twisting or torque force is generated when the chair is moved between forward and rearward positions with the third embodiment structure.

Figure 11:
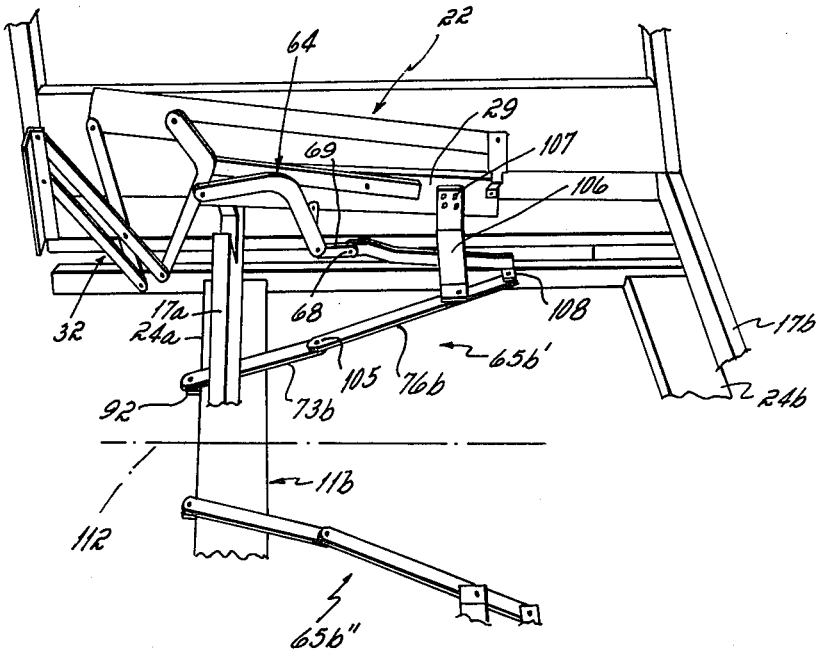
FIG. 11 is a perspective view illustrating a third embodiment of the improved control assembly in structural relation with the recliner linkage assembly, the chair and the recliner linkage assembly being shown in the same upright attitude as shown in FIG. 1.

The third embodiment 65*b* of improved control assembly includes a swing link 73*b* pivotally connected to cross frame member 24*a* of the chair base 11 at vertical pivot axis 74*b*, same being pinned to an ear 92 screwed to that cross frame member. The swing link 73*b* is pivotally connected at its other end on vertical axis 105 to a primary control link 76*b*. The primary control link 76*b* is pivotally connected on vertical axis 79*b*, intermediate its ends, to a mounting bracket 106 connected by screws 107 to side rail 29 of the body support frame 12. The other end of the primary control link 76*b* is pivotally connected on a vertical axis 77*b* to horizontal ear 108 of connecter link 78. The connecter link 78*b* is pivotally connected at its other end to bellcrank 69 on horizontal pivot axis 68. The actuator linkage 64 provided for the third embodiment 65*b* of the control linkage assembly as illustrated in FIG. 11 is identical to the actuator linkage 64 provided for the first 65 and second 65*a* embodiments of the control linkage assembly as shown in FIGS. 1–6, thereby directly connecting the third embodiment of the control linkage assembly with the recliner linkage assembly 22 and the leg rest linkage assembly 32. Likewise, the recliner linkage assembly 22 and leg rest linkage assembly 32*b* illustrated in FIG. 11 in combination with the control linkage assembly's third embodiment 65*b* is the same as is illustrated in FIGS. 1–6 for the first 65 and second 65*a* embodiments. The actuator linkage, recliner linkage 22 and leg rest linkage 32 was all described in substantial detail above.

Use of the third embodiment 65*b* of the improved control linkage assembly is illustrated particularly in FIGS. 12–14. It is to be understood that the pair of control assemblies 65*b*' and 65*b*'', as illustrated in FIG. 11, operate in tandem and in mirror relation one with the other relative to a vertical plane through the center of the chair that includes phantom longitudinal center line 112. Therefore, it is necessary to describe operation of the control linkage's third embodiment 65*b* with respect to one such linkage only.

As shown in FIG. 12, the chair and the control linkage 65*b* are disposed in the upright position. As illustrated in FIG. 12, and for the upright position, note particularly that the pivot point 105 connecting the swing link 73*b* and the primary control link 76*b* is disposed to the outside (relative to the side rails 31 of the chair) of the centerline 101*b* that passes through pivotal connection 74*b* of the swing link with the cross frame member 24*a*, and is on the inside of that centerline when the chair is in the intermediate reclining position (shown in FIG. 13) and as well as in the full reclining position (as shown in FIG. 14). As with the first 65 and second 65*a* embodiments of the improved control linkage assembly, this orientation of pivot point 105 tends to retain the chair in the upright position vis-a-vis the reclining positions, and in the reclining positions vis-a-vis the upright position, when the chair is so oriented as desired by the user, thereby precluding inadvertent transfer or motion of the chair from one position to the other in response to small force movements of the user within the chair. Further, and as is particularly illustrated in FIG. 12, note that the swing link 73*b* and primary control link 76*b* approach, but do not fall in line with nor to the outside of (relative to the side rails 31 of the chain), pivot centerline 110*b* which connects the pivot point 74*b* (where swing link 73*b* is pivotally connected to the body support frame 12) and the intermediate pivot point 79*b* (where primary control link 76*b* is pivotally connected to the body support frame), i.e., those links 73*b*, 76*b* are always positioned on the inside of the pivot centerline 110*b* in all of the upright reclining positions of the chair. In this regard, it is important that the pivot point 74*b* be located so that there is no chance of the connecting pivot point 105 passing substantially over onto the outside of that centerline 110*b*. If such should occur, the control linkage would become locked up and immobile when any effort was made to move the chair from the upright to the intermediate reclining or full reclining positions. Thus, it is important that the links 73*b*, 76*b* (and analogous links 73, 76 and 73*a*, 76*a* in the case of primary embodiment 65 and the second embodiment 65*a*, respectively of the improved control linkage assembly) be sized so that the intermediate or movable pivot point 105 (analogous points 76, 85 for first 65 and second 65*a* embodiment) do not pass over the phantom centerline 110*b* (analogous centerline 110 for first 65 and second 65*a* embodiment) connecting the primary control link and the swing link pivot axes with the body support frame.

The improved control assembly embodiments 65, 65*a* and 65*b* of this invention have been shown in operable combination with a recliner linkage assembly 22 that tilts a one-piece body support 13, ie., a one-piece seat 14 and backrest 15 combination. In other words, the recliner linkage used to illustrate the improved control assembly 65, 65*a* and 65*b* of this invention functions with that type of body support 13 where the backrest 15 and seat 14 are fixed one to the other. As previously mentioned, such a recliner linkage assembly 22 is well known to the art. There is also known to the art a recliner linkage assembly (not shown) that is operable with a body support (not shown) where the backrest and seat are pivotally connected one to the other. In this latter type recliner linkage assembly, a still further reclining position (vis-a-vis the two reclining positions shown in FIGS. 3 and 5 for the recliner linkage 22) is provided in which the backrest and the seat are disposed close to horizontal so as to transpose the chair into a simulated bed. The type of recliner linkage assembly which provides this still further reclining or bed-like position of the chair may also be used in structural combination with any of the three embodiments 65, 65*a* or 65*b* of the improved control assembly of this invention. A typical embodiment of this latter type recliner linkage assembly is illustrated in U.S. Pat. No. 3,572,823.

Having described in detail the preferred embodiment of my invention, what I desire to claim and protect by Letters Patent is:

1. In a reclining chair of the type including a body support mounted on a body support frame, said body support including a chair seat and a chair backrest, recliner linkage connecting said chair seat and said body support frame to permit limited tilting movement of said chair seat between an upright position and at least one reclining position, said chair seat being tilted in the reclined position relative to the chair seat attitude in the upright position, and said recliner linkage being partially mounted on said body support frame, and a stationary chair base on which said body support frame is carried for forward and rearward motion relative to said chair base, the improvement comprising a control assembly directly connected in a mechanical linkage series between said chair base and said recliner linkage assembly, said control assembly also being connected to said body support frame, said control assembly being operative through direct mechanical connection and coaction with said recliner linkage assembly to control forward and rearward movement of said body support frame relative to said stationary base as said chair seat tilts between the upright and reclining positions and said control assembly being entirely positioned beneath said chair seat in all of the upright and reclining positions of said reclining chair.

2. An improvement as set forth in claim 1 wherein said control assembly is oriented in a generally horizontal plane.

3. An improvement as set forth in claim 1, said body support frame including spaced side rails and spaced front and rear cross rails, said control assembly being positioned substantially within a space having side walls defined by opposed vertical phantom planes each of which includes one of said body support frame's side rails, and by opposed vertical phantom planes one of which includes said body support frame's front cross rail and one of which includes said body support frame's rear cross rail, having a floor defined by the floor on which said reclining chair is seated, and having a ceiling defined by said chair's seat.

4. An improvement as set forth in claim 1, said control assembly including a swing link pivotally connected with a primary control link, said swing link being pivotally connected at one end to said chair base and said control link being pivotally interconnected at one end to said recliner linkage.

5. An improvement as set forth in claim 4, said primary control link also being pivotally connected intermediate its ends to said body support frame to provide a fixed pivot point for said control assembly relative to said body support frame.

6. An improvement as set forth in claim 4, the pivotal connection between said swing and primary control links being movable between upright and reclining position, said pivotal connection being located to one side of a phantom center line that includes the pivotal connection of said swing link and said body support frame and that is oriented parallel to the motion path of said movable support frame when said chair is in one of said upright and reclining positions, and being located to the other side of said phantom center line when said chair is in the other of said upright and reclining positions.

7. An improvement as set forth in claim 1, said chair including a recliner linkage connecting said chair seat and said body support frame on each side of said chair, wherein only one control assembly is provided to directly connect said chair base and said recliner linkage assembly on one side of said chair only.

8. An improvement as set forth in claim 1, said chair seat including a recliner linkage connecting said chair seat and said body support frame on each side of said chair, wherein two control assemblies are provided, each control assembly being directly connected with said chair base and said recliner linkage on one side of said chair only.

9. An improvement as set forth in claim 1, said control assembly being directly connected to said recliner linkage assembly through an actuator assembly, said actuator assembly permitting a minor movement of said recliner linkage to be transposed into a major movement of said seat support frame.

10. An improvement as set forth in claim 1, said control assembly including a parallel linkage structure comprising a primary and a secondary control link in parallel position relative one to the other, said control links being pivotally connected at adjacent one ends to a movable cross link, the other end of said secondary control link being pivotally connected to said body support frame and the other end of said primary control link being pivotally connected to said recliner linkage assembly, and said primary control link being pivotally connected intermediate its ends of said body support frame, and a swing link pivotally connected at one end to said movable cross link and pivotally connected at its other end to said stationary chair base.

11. An improvement as set forth in claim 10, said control assembly including an acutator bellcrank connecting said primary control link to said recliner linkage assembly, said bellcrank permitting a minor movement of said recliner linkage to be transposed into a major movement of said set support frame.

12. An improvement as set forth in claim 10 including a connector plate, said primary control link being pivotally connected at its other end to said connector plate, an alignment link pivotally connected at one end to said body support frame and pivotally connected at the other end to said connector plate and, a connector arm pivotally mounted to said connector plate, said connector arm connecting said control linkage assembly with said recliner linkage assembly.

13. An improvement as set forth in claim 1 including a leg rest linkage assembly connected to said recliner linkage assembly.

14. In a reclining chair of the type including a body support mounted on a body support frame, said body support comprising a chair seat and a chair backrest, recliner linkage connecting said chair seat and said body support frame to permit limited tilting movement of said chair seat between an upright position and at least one reclining position, said chair seat attitude being tilted in the reclined position relative to the chair seat attitude in the upright position, and a stationary chair base on which said body support frame is mounted for forward and rearward motion relative to said chair base, the improvement comprising a control assembly operatively interconnected between said chair seat and said chair base, said control assembly being positioned entirely within said body support frame and entirely beneath said chair seat in both of the upright and reclining positions, and said control assembly being operative to cause forward movement of said chair backrest relative to said stationary base as said chair seat tilts from the upright position to the reclining position.

15. An improvement as set forth in claim 14 wherein said control assembly is oriented in a generally horizontal plane.

16. An improvement as set forth in claim 14, said control assembly being positioned entirely beneath said chair seat in all of the upright and reclining positions.

17. An improvement as set forth in claim 14, said body support frame including spaced side rails and spaced front and rear cross rails, said control assembly being positioned substantially within a space having side walls defined by opposed vertical phantom planes each of which includes one of said body support frame's side rails and by opposed vertical phantom planes one of which includes said body support frame's front cross rail and one of which includes said body support frame's rear cross rail, having a floor defined by the floor on which said reclining chair is seated, and having a ceiling defined by said chair's seat.

18. An improvement as set forth in claim 14, said control assembly being directly connected in series between said chair base and said recliner linkage assembly.

19. An improvement as set forth in claim 18, said control assembly including a swing link pivotally connected with a primary control link, said swing link being pivotally connected at one end to said chair base and said control link being pivotally interconnected at one end to said recliner linkage.

20. An improvement as set forth in claim 19 said primary control link also being pivotally connected intermediate its ends to said body support frame to provide a fixed pivot point for said control assembly relative to said body support frame.

21. An improvement as set forth in claim 19, the pivotal connection between said swing and primary control links being movable between upright and reclining positions of said seat support, said pivotal connection being located to one side of a phantom center line that includes the pivotal connection of said swing link and said body support frame and that is oriented parallel to the motion path of said movable support frame when said chair is in one of said upright and reclining positions, and being located to the other side of said phantom center line when said chair is in the other of said upright and reclining positions.

22. An improvement as set forth in claim 14, said chair including a recliner linkage connecting said chair support and said body support frame on each side of said chair, wherein only one control assembly is provided to directly connect said chair base and said recliner linkage assembly on one side of said chair only.

23. An improvement as set forth in claim 14, said chair seat including a recliner linkage connecting said chair seat and said body support frame on each side of said chair, wherein two control assemblies are provided, each control assembly being directly connected with said chair base and said recliner linkage on one side of said chair only.

24. An improvement as set forth in claim 14, said control assembly being directly connected to said recliner linkage assembly through an actuator assembly, said actuator assembly permitting a minor movement of said recliner linkage to be transposed into a major movement of said seat support frame.

25. An improvement as set forth in claim 14, said control assembly including a parallel linkage structure comprising a primary and a secondary control link in parallel position relative one to the other, said control links being pivotally connected at adjacent one ends to a movable cross link, the other end of said secondary control link being pivotally connected to said body support frame and the other end of said primary control link being pivotally connected to said recliner linkage assembly, and said primary control link being pivotally connected intermediate its ends of said body support frame, and a swing link pivotally connected at one end to said movable cross link and pivotally connected at its other end to said stationary chair base.

26. An improvement as set forth in claim 19 said control assembly including an actuator bellcrank connecting said primary control link to said recliner linkage assembly, said bellcrank permitting a minor movement of said recliner linkage to be transposed into a major movement of said seat support frame.

27. An improvement as set forth in claim 25, including a connector plate, said primary control link being pivotally connected at its other end to said connector plate, an alignment link pivotally connected at one end to said body support frame and pivotally connected at the other end to said connector plate and, a connector link pivotally mounted to said connector plate, said connector arm connecting said control linkage assembly with said recliner linkage assembly.

28. An improvement as set forth in claim 14, including a leg rest linkage assembly connected to said recliner linkage assembly.

29. An improvement as set forth in claim 14 wherein said control assembly is also connected to said body support frame.

* * * * *

UNITED STATES PATENT AND TRADEMARK OFFICE

CERTIFICATE OF CORRECTION

PATENT NO. : 4,099,776

DATED : July 11, 1978

INVENTOR(S) : Donald Crum et al

It is certified that error appears in the above-identified patent and that said Letters Patent are hereby corrected as shown below:

| | | |
|---|---|---|
| Col. 1 | Line 16 "a" | should be -- an -- |
| Col. 7 | Line 37 "24a, 24al" | should be -- 24aa, 24ab, -- |
| Col. 8 | Line 52 "top" | should be -- stop -- |
| Col. 10 | Line 2 "apairs" | should be -- pairs -- |
| Col. 10 | Line 39 "78" | should be -- 78b -- |
| Col. 10 | Line 54 "linkage" | should be -- linkage 64 -- |
| Col. 13 | Line 48 "set" | should be -- seat -- |
| Col. 14 | Line 56 "seat support" | should be -- chair seat -- |
| Col. 14 | Line 66 and 67 "chair support" | should be -- chair seat -- |

Signed and Sealed this

*Second* Day of *January 1979*

[SEAL]

*Attest:*

RUTH C. MASON
*Attesting Officer*

DONALD W. BANNER
*Commissioner of Patents and Trademarks*